US008555658B2

(12) United States Patent
Kim et al.

(10) Patent No.: US 8,555,658 B2
(45) Date of Patent: Oct. 15, 2013

(54) ICE MAKER, REFRIGERATOR HAVING THE SAME, AND ICE MAKING METHOD THEREOF

(75) Inventors: Seong-Jae Kim, Seoul (KR); Bong-Jin Kim, Seoul (KR); Young-Hoon Yun, Seoul (KR)

(73) Assignee: LG Electronics Inc., Seoul (KR)

( * ) Notice: Subject to any disclaimer, the term of this patent is extended or adjusted under 35 U.S.C. 154(b) by 710 days.

(21) Appl. No.: 12/756,918

(22) Filed: Apr. 8, 2010

(65) Prior Publication Data

US 2010/0319367 A1 Dec. 23, 2010

(30) Foreign Application Priority Data

Jun. 22, 2009 (KR) ..... 10-2009-0055659

(51) Int. Cl.
*F25C 5/02* (2006.01)

(52) U.S. Cl.
USPC ..... 62/71

(58) Field of Classification Search
USPC ..... 62/465, 71, 340, 449, 441
See application file for complete search history.

(56) References Cited

U.S. PATENT DOCUMENTS 5,947,342 A * 9/1999 Song ..... 222/413
7,263,854 B2 * 9/2007 Lee et al. ..... 62/351

FOREIGN PATENT DOCUMENTS

JP 6-2073 U 1/1994
KR 2000-0007731 U 5/2000
KR 10-2007-0009345 A 1/2007

* cited by examiner

*Primary Examiner* — Melvin Jones
(74) *Attorney, Agent, or Firm* — Birch, Stewart, Kolasch & Birch, LLP

(57) ABSTRACT

An ice maker, a refrigerator including the ice maker, and an ice making method are provided. The ice maker includes a tray having a predetermined length and to which water is supplied to make ice. The ice maker is configured to mechanically separate the ice from the tray by using pistons which are driven by being pressed by structures. This allows the ice maker to have a reduced size, and a small occupation area, thereby implementing a slim configuration of a refrigerator. Furthermore, since an installation height of the ice maker is lowered, a path for supplying cool air may be shortened. This may prevent loss of cool air being supplied to the ice making chamber. Since the ice maker has a simplified configuration and precise operation controls, the fabrication costs may be reduced, and inferiority of the ice maker due to malfunctions may be prevented.

16 Claims, 10 Drawing Sheets

ICE MAKER, REFRIGERATOR HAVING THE SAME, AND ICE MAKING METHOD THEREOF

RELATED APPLICATION

The present disclosure relates to subject matter contained in priority Korean Application No. 10-2009-0055659, filed on Jun. 22, 2009, which is herein expressly incorporated by reference in its entirety.

BACKGROUND OF THE INVENTION

1. Field of the Invention

The present invention relates to an ice maker, a refrigerator including the ice maker, and an ice making method, and particularly, to an ice maker that occupies a small space and provides an enhanced degree of spatial utilization and placement options within a refrigerator.

2. Background of the Invention

A home refrigerator serves to store food items in an accommodation space at a low temperature. The refrigerator is divided into a freezing chamber for storing food items at a temperature below zero degrees Celsius, and a refrigerating chamber for storing food items at a temperature above zero degrees Celsius. As demands for ice increases, a large number of refrigerators having automatic ice makers for making ice are being presented.

The ice maker may be installed at either the freezing chamber or the refrigerating chamber, depending on the type of refrigerator. In the case of installing the ice maker at the refrigerating chamber, cool air inside the freezing chamber is guided to the ice maker to perform an ice making operation.

Methods for separating ice from the ice maker may include a torsion method, an ejection method, and a rotation method. The torsion method is a method for separating ice by twisting the ice maker, the ejection method is a method for separating ice from the ice maker by an ejector installed above the ice maker, and the rotation method is a method for separating ice by rotating the ice maker.

However, the conventional ice makers and refrigerators provided with the conventional ice makers have several drawbacks.

Firstly, the conventional ice maker makes ice by containing water in a horizontal ice container. Here, the ice container occupies a large space, and an ice separation unit for separating ice from the ice maker occupies a large space. This may reduce the entire utilization space inside the refrigerator. Furthermore, in the case of reducing the size of the ice maker, the amount of ice that can be made at one time is reduced. This may cause ice not to be rapidly provided in summer when a large amount of ice is required.

Secondly, the conventional ice maker has a structure to drop formed ice downwardly to a location below the ice maker. Accordingly, in the case of a refrigerator having a dispenser, an ice making chamber has to be installed at a position higher than the dispenser. However, in the case of a 3-door bottom freezer type refrigerator where a freezing chamber is installed at a lower side and a refrigerating chamber including an ice making chamber is installed at an upper side, when the ice making chamber is installed at a high position, the freezing chamber is spaced far from the ice making chamber, and cooling air loss may occur when cool air from the freezing chamber is transferred to the ice making chamber. This may reduce the energy efficiency of the refrigerator.

Thirdly, the conventional ice maker has an ice making unit and an ice separating unit operated by individual mechanisms. This may cause the entire configuration and control to be complicated, resulting in an increase in the fabrication costs of the ice maker.

SUMMARY OF THE INVENTION

Therefore, an object of the present invention is to provide an ice maker having a slim configuration which occupies a small space within a refrigerator.

Another object of the present invention is to provide an ice maker locatable within a refrigerator at a location that permits a reduction of air loss occurring when cool air in a freezing chamber is supplied to an ice making chamber, by shortening a distance between the freezing chamber and the ice making chamber by lowering an installation height of the ice maker.

Still another object of the present invention is to provide an ice maker capable of reducing fabrication costs and reducing malfunctions thereof by having a simplified configuration and precise controls.

Still other objects of the present invention are to provide a refrigerator having the ice maker, and an ice making method thereof.

To achieve these and other advantages and in accordance with the purpose of the present invention, as embodied and broadly described herein, there is provided an ice maker, comprising: a tray having an ice making space; a driving unit for rotating the tray; and a piston for separating ice from the tray by pushing up the ice in a slidably coupled state to the tray.

To achieve these and other advantages and in accordance with the purpose of the present invention, as embodied and broadly described herein, there is also provided a refrigerator, comprising: a refrigerator body; a freezing chamber formed at the refrigerator body; a refrigerating chamber formed at the refrigerator body, and partitioned from the freezing chamber; an ice making chamber installed at the refrigerating chamber of the refrigerator body, for making ice by receiving cool air inside the freezing chamber; and an ice maker installed inside the ice making chamber, for making ice, wherein the ice maker separates ice from a tray by a piston slidably coupled to the tray when the tray is rotated.

To achieve these and other advantages and in accordance with the purpose of the present invention, as embodied and broadly described herein, there is still also provided an ice making method of a refrigerator, comprising: a water supplying step for supplying water to a tray; an ice making step for cooling the water contained in the tray, and thereby making ice; and an ice separating step for separating the ice inside the tray from the tray by pushing up the ice by a piston while rotating the tray.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A description will now be given in detail of the present invention, with reference to the accompanying drawings.

Hereinafter, an ice maker, a refrigerator having the same, and an ice making method thereof according to the present invention will be explained in more detail with reference to the attached drawings.

Figure 1:
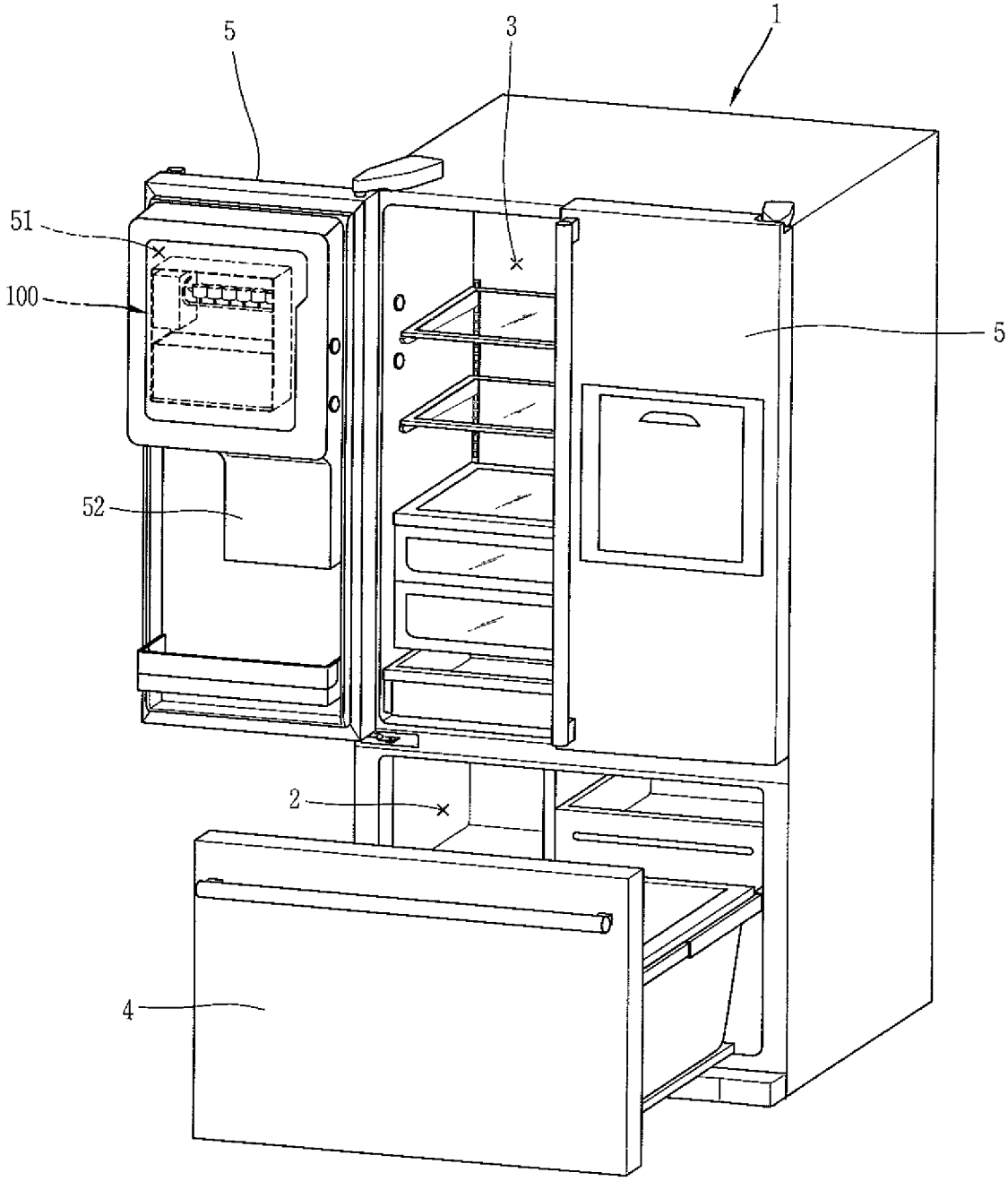
FIG. 1 is a perspective view of a bottom freezer type refrigerator having an ice maker according to the present invention.

Referring now to FIG. 1, the refrigerator according to the present invention comprises a freezing chamber 2 installed at a lower side of a refrigerator body 1 and configured to store food items at a temperature below zero degrees Celsius, and a refrigerating chamber 3 installed at an upper side of the refrigerator body 1 and configured to store food items at a temperature above zero degrees Celsius. A freezing chamber door 4 is slidably installed at the freezing chamber 2 so as to open and close the freezing chamber 2 in a drawer-like manner. A plurality of refrigerating chamber doors 5 are rotatably installed at both sides of the refrigerating chamber 3 so as to open and close the refrigerating chamber 3. A mechanical chamber is located at a lower end of a rear portion of the refrigerator body 1 where a compressor and a condenser are installed.

An evaporator for supplying cool air to the freezing chamber 2 or the refrigerating chamber 3 by being connected to the compressor and the condenser is installed at a rear portion of the refrigerator body 1, between an outer case and an inner case at a rear wall of the freezing chamber. However, the evaporator may be installed at a side wall or an upper wall or the refrigerator body. Alternatively, the evaporator may be installed at a barrier wall partitioning the freezing chamber 2 and the refrigerating chamber 3 from each other. One single evaporator may be installed only at the freezing chamber 2 to supply cool air to the freezing chamber 2 and the refrigerating chamber 3 in a distribution manner. Alternatively, a freezing chamber evaporator and a separate refrigerating chamber evaporator may be installed respectively, so as to independently supply cool air to the freezing chamber 2 and the refrigerating chamber 3.

An ice making chamber 51 for making ice and storing the ice is formed at an upper inner wall surface of the refrigerating chamber door 5. An ice maker 100 for making ice is installed inside of the ice making chamber 51. A dispenser 52 is located below the ice making chamber 51, so as to be outwardly exposed on a front side of the refrigerator chamber door 5, so that ice made by the ice maker 100 can be drawn out of the refrigerator.

The operation of the refrigerator will now be explained.

Once a load is detected from the freezing chamber 2 or the refrigerating chamber 3, the compressor is operated to generate cool air by the evaporator. A portion of the cool air is supplied to the freezing chamber 2 and the refrigerating chamber 3 in a distribution manner, whereas another portion of the cool air is supplied to the ice making chamber 51. The cool air supplied to the ice making chamber 51 is heat-exchanged so that ice can be formed by the ice maker 100 mounted at the ice making chamber 51, and then is returned into the freezing chamber 2 or is supplied to the refrigerating chamber 3. The ice made by the ice maker 100 is drawn out through the dispenser 52. These processes are repeatedly performed.

Figure 2:
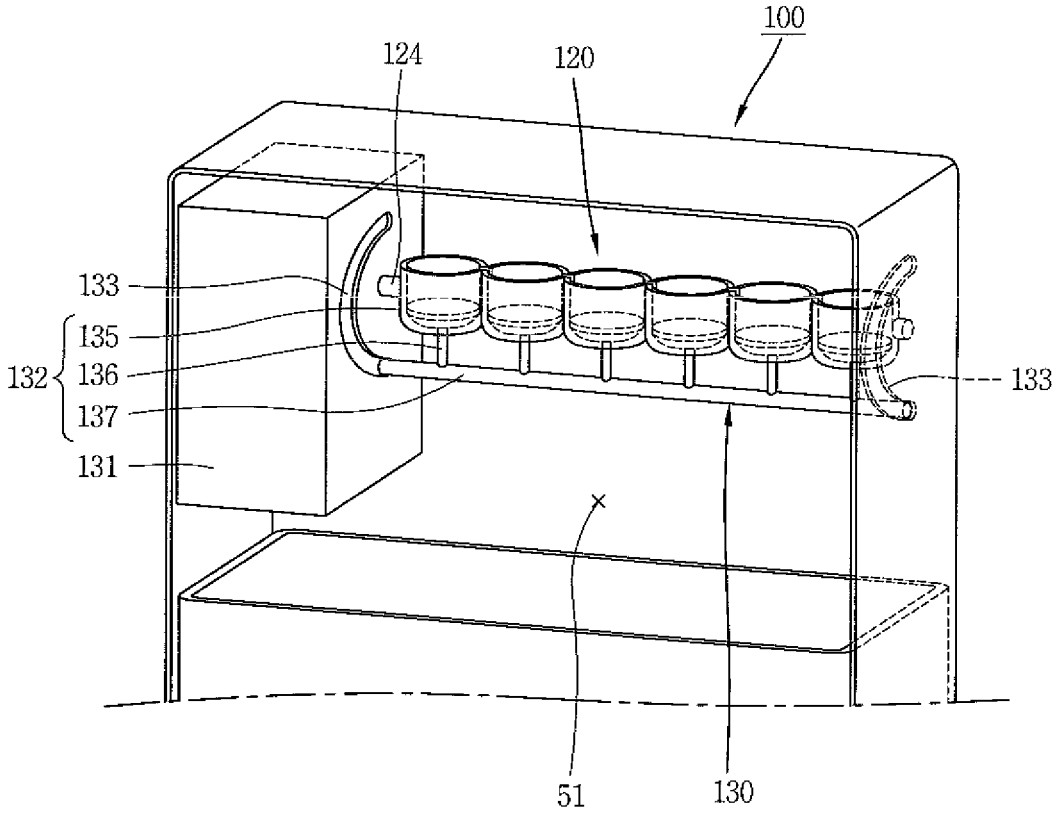
FIG. 2 is a perspective view showing the ice maker of FIG. 1.

As shown in FIG. 2, the ice maker 100 includes a water supply unit 110 connected to a water supply source for supplying water, a tray 120 for performing an ice making operation by receiving the water supplied from the water supply unit 110, and for performing an ice separating operation by being rotated when the ice making process has been completed, and an ice separation unit 130 for separating ice made in the tray 120 from the tray 120 in a pushing manner.

Figure 3:
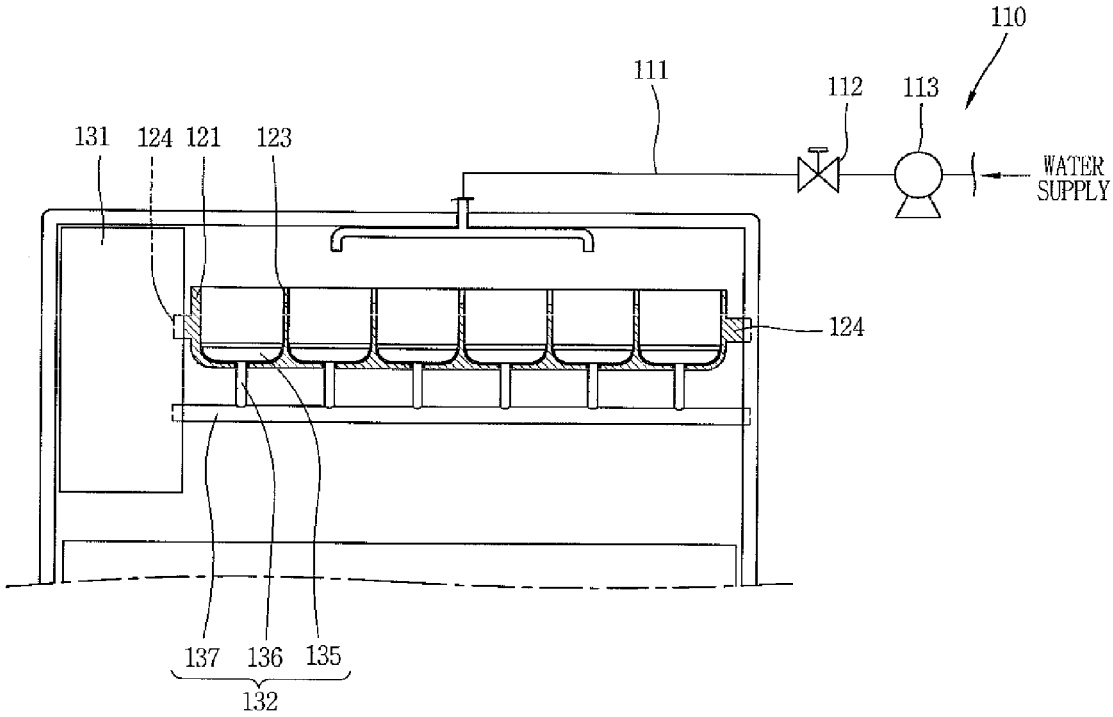
FIG. 3 is a front partial sectional view showing the ice maker of FIG. 1.

As shown in FIG. 3, the water supply unit 110 includes a water supply pipe 111 for connecting the water supply source to the tray 120, a water supply valve 112 installed at an intermediate part of the water supply pipe 111 for controlling a water supply amount. A water supply pump 113 may be provided at an upstream side or a downstream side of the water supply valve 112 for pumping water. The water supply pump 113 serves to supply a uniform water pressure and flow. However, the water supply pump 113 is not necessarily required. For example, where the water supply pump 113 is not provided, water supply may be performed by using a height difference between the water supply source and the tray 120. However, in case of communicating the water supply pipe 111 to ice making cylinders, the water supply pump is preferably provided for boosting of a water pressure.

The water supply pipe 111 may be independently connected to ice making cylinders 121 of the tray 120. However, as shown in the drawings, when the water supply pipe 111 is connected to one ice making cylinder 121, the other ice making cylinders are made to be communicated with the one ice making cylinder 121 for water flow, which is preferable in the aspects of controls and fabrication costs. For instance, as shown in FIG. 3, the water supply pipe 111 is installed so that an outlet thereof can be positioned above the ice making cylinders 121 at a predetermined distance, thereby supplying water dropping from the outlet of the water supply pipe 111 to the ice making cylinders 121.

Figure 4:
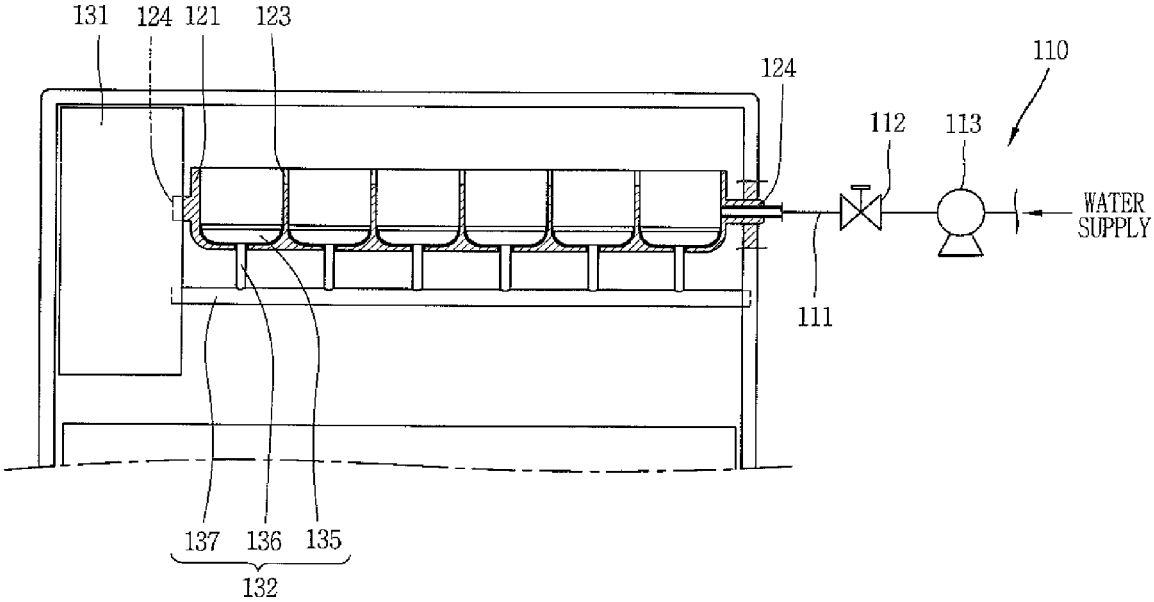
FIG. 4 is a front partial sectional view of the ice maker of FIG. 1 showing a water supply unit according to another embodiment of the present invention.

However, in this case, the rotation motion of the tray 120 may be impeded. Accordingly, it is preferable to communicate the outlet of the water supply pipe 111 with a side wall surface of the ice making chamber 51 to which the tray 120 is coupled. For instance, as shown in FIG. 4, the water supply pipe 111 is connected to hinge protrusions 124 of the tray 120. One of the hinge protrusions 124 is penetratingly formed at the ice making chamber 51 so as to be communicated with ice making spaces (S) of the ice making cylinders 121. Accordingly, water is supplied to the ice making spaces (S) through the hinge protrusion 124.

The water supply pipe 111 may be directly connected to the water supply source, or the water supply pipe 111 may be connected to a water tank storing a predetermined amount of water therein and provided in the refrigerating chamber 3. In this case, the water tank serves as the water supply source. In order to supply a predetermined amount of water to the tray 120, a water level sensor may be installed at the tray 120, a flow amount sensor for sensing a flow amount of water may be installed at the water supply pipe, or a water level sensor may be installed at the water tank.

The water supply valve 112 and the water supply pump 113 may be electrically connected to a control unit 150 so as to exchange signals with each other. The control unit 150 may control a water supply amount based on a real time value sensed by the water level sensor or the flow amount sensor. Alternatively, the control unit 150 may periodically turn on/off the water supply valve 112 and the water supply pump 113 by setting an operation time of the water supply valve 112 and the water supply pump 113 according to predefined data.

As shown in FIGS. 2 to 4, a single tray 120 may be provided according to an ice making capacity of the refrigerator. However, a plurality of trays 120 may be provided for increasing an ice making capacity of the refrigerator. When a plurality of trays 120 are provided, the plurality of trays 120 may be arranged in one line, or may be arranged in a plurality of lines, taking into consideration the relationships with the peripheral components. In order to minimize each width of the trays 120 in back and forth directions, the trays 120 are preferably arranged on the same plane in one line. However, in order to minimize each width of the trays 120 in right and left directions, the trays 120 are preferably arranged in a plurality of lines. The arrangement of the trays 120 may be suitably controlled according to particular needs.

Figure 5:
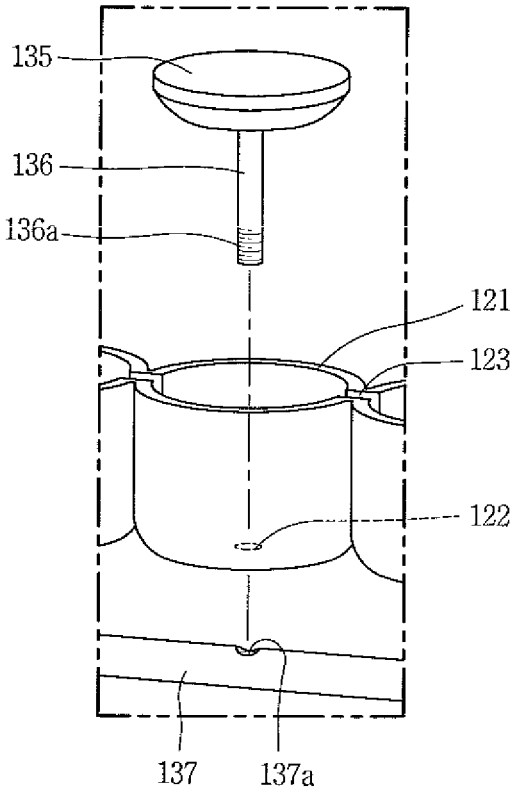
FIG. 5 is an exploded perspective view of a piston of an ice separation unit of FIG. 1.

The tray 120 is implemented as the plurality of ice making cylinders 121 each having the ice making space (S) horizontally arranged in parallel to each other. The ice making cylinders 121 are formed so that the upper ends thereof can be open, while the lower ends thereof can be closed. As shown in FIG. 5, the closed lower ends of the ice making cylinders 121 are provided with sliding holes 122 through which rod portions 136 of the pistons 132 slidably penetrate.

As shown in FIG. 3, the water supply pipe 111 is installed at a predetermined height so as to supply water to one of the ice making cylinders 121, especially, the intermediate ice making cylinder 121. A water flow path 123 may be formed so that water can flow between the intermediate ice making cylinder 121 and other ice making cylinders adjacent to the intermediate ice making cylinder 121. The water flow path 123 may be implemented as holes, or grooves formed at upper ends of the openings.

Two hinge protrusions 124 are formed at the two outermost ice making cylinders 121. One of the two hinge protrusions 124 is coupled to a rotation shaft of a driving motor 131, and the other of the two hinge protrusions 124 is rotatably coupled to the ice making chamber 51.

As discussed above, the hinge protrusion 124 rotatably coupled to the ice making chamber 51 may be formed to penetrate the ice making chamber 51, and the outlet of the water supply pipe 111 may be connected to the hinge protrusion 124. In this case, the water supply pipe 111 need not be installed at an upper side of the ice making cylinders 121. This may permit a rotation angle of the try 120 to be increased, thereby facilitating the ice separating operation. The hinge protrusions 124 may be formed at or near the openings at the upper ends of the ice making cylinders 121 in order to facilitate the supply of water into the ice making cylinders 121. However, it is preferable to form the hinge protrusions 124 at intermediate portions of the ice making cylinders 121, taking into consideration a rotation radius of the tray 120. This may reduce an occupation space of the ice maker. Accordingly, the hinge protrusions 124 may be properly designed taking into consideration the aspects of water supply and a spatial utilization degree.

As shown in FIGS. 2 and 5, the ice separation unit 130 includes a driving motor 131 for rotating the tray 120, pistons 132 coupled to the tray 120 for pushing the ice made in the ice making cylinders 121 of the tray 120, and piston guides 133 for guiding the pistons 132 to have a sliding motion with respect to the ice making cylinders 121 when the tray 120 is rotated.

The driving motor 131 is installed at one side of the tray 120 in a horizontal direction so as to support one side of the tray 120. A rotation shaft of the driving motor 131 is coupled to the hinge protrusion 124 provided at one side surface of the tray 120 in a horizontal direction so that the driving motor 131 can transmit a rotation force to the tray 120.

The pistons 132 include head portions 135 slidably coupled to inner circumferential surfaces of the ice making cylinders 121 to thereby form ice making spaces (S). The pistons 132 further include rod portions 136 coupled to bottom surfaces of the head portions 135 so as to be extending in a moving direction of the pistons 132. A connecting unit 137 connecting the rod portions 136 with each other is provided for simultaneously moving the plurality of head portions 135 up and down.

The head portions 135 may be formed in a disc shape having nearly the same size as an inner diameter of the ice making cylinders 121. Gaskets having a ring shape may be coupled to outer circumferential surfaces of the head portions 135 for preventing leakage of water from the ice making spaces (S). However, since the lower ends of the ice making cylinders 121 have a closed structure except for the sliding holes, the gaskets are not necessarily required on the outer circumferential surfaces of the head portions 135. That is, even if the gaskets are not provided, the amount of water leaking from the ice making spaces (S) may not be great.

The rod portions 136 are formed in a bar shape having a predetermined length, and are integrally coupled to the centers of the bottom surfaces of the head portions 136. Screw threads 136*a* may be formed at the ends of the rod portions 136 so as to be threadably coupled to coupling grooves 137*a* of the connecting unit 137. It is also possible that the rod portions 136 are forcibly inserted into the connecting unit 137 or coupled to the connecting unit 137 by welding.

The connecting unit 137 is connected to the rod portions 136 in a direction perpendicular to the rod portions 136. Preferably, the connecting unit 137 is formed to have a diameter larger than that of the rod portions 136 so as to have high strength to overcome a resistance of the ice and to move the head portions 135 up and down. Coupling grooves 137*a* may be formed on an outer circumferential surface of the connecting unit 137 at the same interval in a longitudinal direction.

Figure 6A:
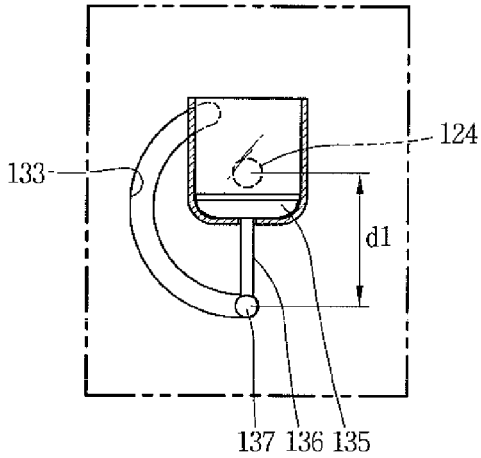
FIG. 6(*a*)-6(*b*) are schematic views showing an ice separating process by a piston of the ice maker of FIG. 1.
Figure 6B:
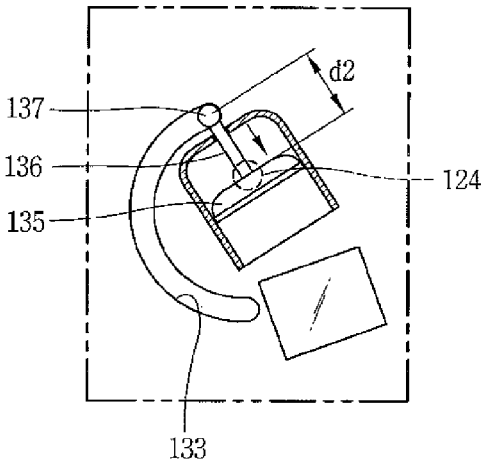

The piston guides 133 are symmetrically formed on an outer surface of the driving motor 131 and an inner circumferential surface of the ice making chamber 51 in an arc shape. The piston guides 133 are preferably formed to be eccentric from the rotation center of the tray 120. More specifically, a distance (d1) from the rotation center of the tray 120 to the end of the connecting unit 137 when the tray 120 stands upright as shown in FIG. 6A, is longer than a distance (d2) from the rotation center of the tray 120 to the end of the connecting unit 137 when the tray 120 is turned upside down as shown in FIG. 6B. The arc shape of the piston guides 133 may be configured such that the distance decreases from d1 to d2 smoothly and gradually throughout an entire range of rotation of the tray 120 to provide continuous gradual movement of the pistons. Alternatively, the arc shape of the piston guides 133 may be configured such that the distance d1 remains constant throughout a first portion of rotation of the tray 120, and then decreases to d2 upon further rotation of the tray 120 to delay movement of the pistons until the ice making cylinders 121 are at or near an inverted position.

The ice inside the ice making cylinders 121 may be separated from the ice making cylinders 121 only by an upward motion of the pistons 132, i.e., by a pushing force of the pistons 132 generated by the driving motor 131. However, the ice may be separated from the ice making cylinders 121 by applying a predetermined amount of heat to the ice making cylinders 121 by a heater installed on an outer circumferential surface of the tray 120, before the ice is pushed up by the pistons 132.

In the case of separating the ice from the ice making cylinders 121 by using the heater, the heater may be implemented as a hot wire heater wound on an outer peripheral surface of the tray 120. In this case, the heater may be formed as a single circuit or a plurality of circuits according to the shape of the tray 120.

The heater may be controlled so as to be communicated with the water supply unit 110. For instance, a microcomputer may determine whether water is being supplied to the tray 120 for ice making, whether an ice making operation is being performed, or whether the ice made in the tray 120 is being separated from the tray 120, according to changes of values sensed by the water level sensor or the flow amount sensor of the water supply unit 110. If it is determined that water is being supplied to the tray 120 for ice making, or if it is determined that an ice making operation is being performed, the operation of the heater is stopped. However, if it is determined that the ice made in the tray 120 is being separated from the tray 120, the operation of the heater is started.

The time to operate the heater may be determined by real-time or periodically sensing the temperature of the tray 120. Alternatively, the heater may be forcibly operated based on a data value set to indicate a lapsed time after changes of values sensed by the water level sensor or the flow amount sensor of the water supply unit 110. That is, whether the ice making operation has been completed or not may be checked by sensing the temperature of the tray 120, or through an ice making time. For instance, when the temperature of the tray 120 measured by a temperature sensor mounted at the tray 120 is less than a predetermined temperature (e.g., about −9 degrees Celsius), it is determined that the ice making operation has been completed. Alternatively, when a predetermined time lapses after a water supply operation, it is determined that the ice making operation has been completed.

Although not shown, the heater may be also implemented as a conductive polymer, a plate heater with a positive thermal coefficient, an AL thin film, or a heat transfer material, rather than the aforementioned hot wire heater.

Rather than being attached onto the outer peripheral surface of the tray 120, the heater may instead be installed inside the tray 120, or may be provided on an inner surface of the tray 120. Alternatively, the tray 120 may be implemented as a heating resistor which emits heat when electricity is applied to one or more parts thereof. This may allow the tray 120 to serve as the heater without installing an additional heater.

The heater may operate as a heat source by being installed at a position spaced from the tray 120 by a predetermined distance, without coming in contact with the tray 120. As another example, the heat source may be implemented as an optical source for irradiating light to at least one of the ice and the tray 120, or a magnetron for irradiating microwaves to at least one of the ice and the tray 120. The heat source such as the heater, the optical source, and the magnetron melts a part of an interface between the ice and the tray 120, by applying thermal energy to at least one of the ice and the tray 120, or the interface therebetween. Accordingly, once the pistons 132 are operated, the ice is separated from the tray 120 by the pistons 132 even in a condition where the interface between the ice and the tray 120 has not melted completely.

Figure 7:
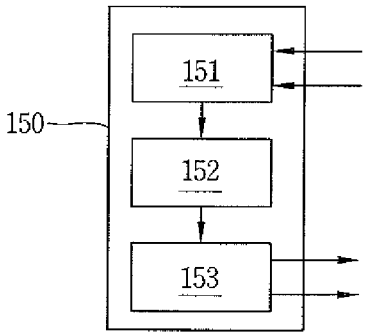
FIG. 7 is a schematic view showing a configuration of a control unit of FIGS. 3 and 4.

The driving motor 131 may be controlled by a control unit 150, i.e., a microcomputer electrically connected to the driving motor 131. For instance, as shown in FIG. 7, the control unit 150 includes a sensing unit 151 for sensing the temperature of the tray 120 or sensing a lapsed time after water supply, a determination unit 152 for determining whether the ice making operation has been completed or not by comparing the temperature or time sensed by the sensing unit 151 with a reference value, and a command unit 153 for controlling whether to operate the driving motor 131 based on the determination by the determination unit 152. When a heater is provided, the control unit 150 may also control the operation of the heater.

Figure 8A:
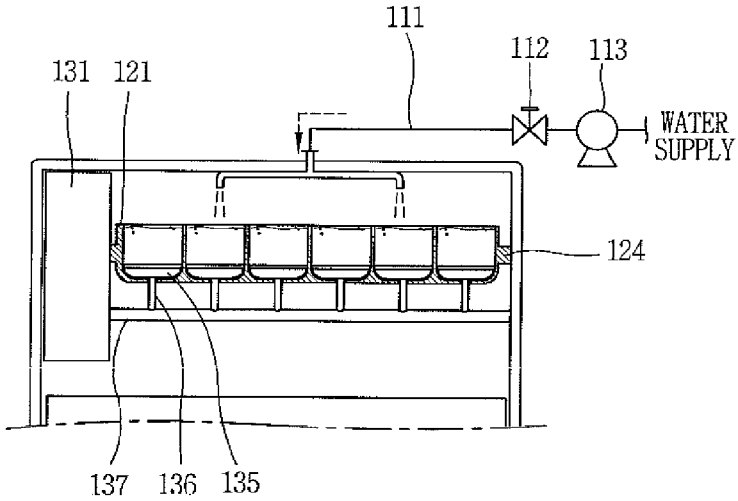
FIGS. 8(*a*)-8(*c*) are longitudinal sectional views showing an ice making process by the ice maker of FIG. 2.
Figure 8B:
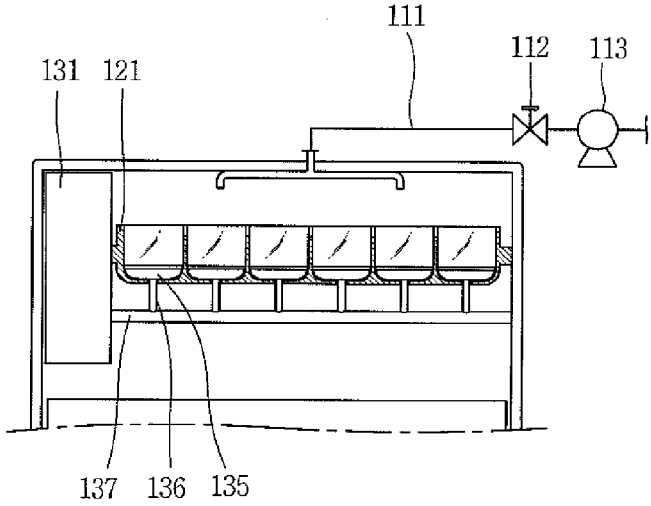
Figure 8C:
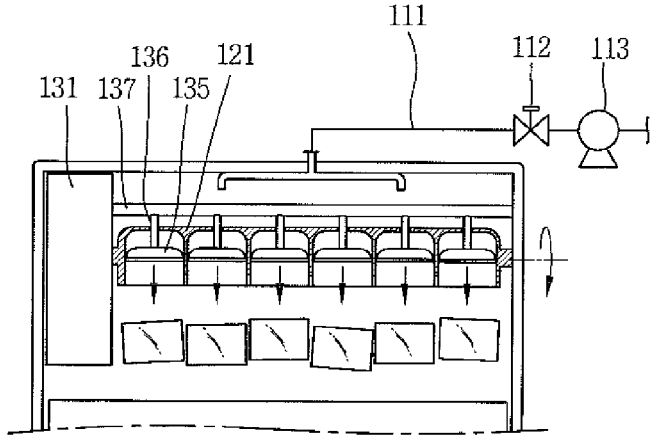
Figure 9:
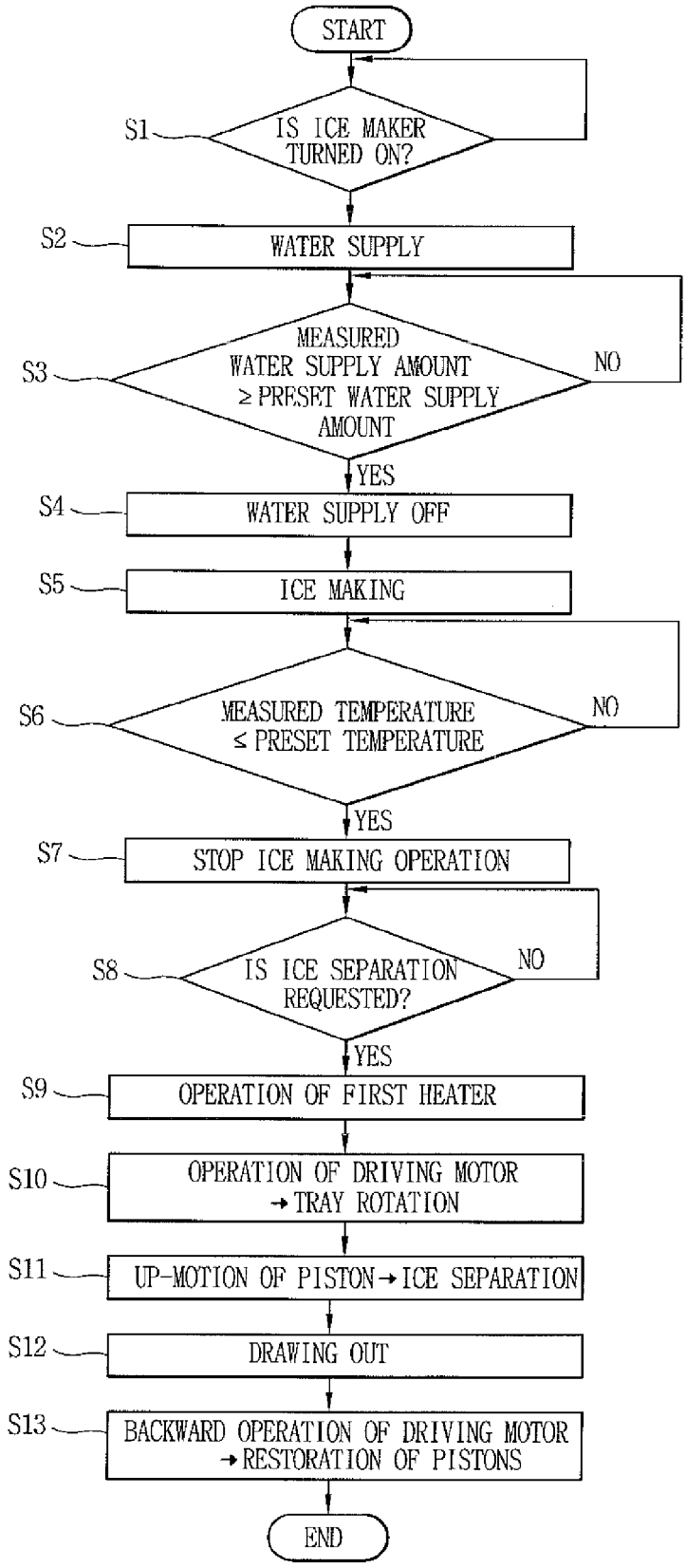
FIG. 9 is a flowchart showing an ice making process by the ice maker of FIG. 2.

Referring now to FIGS. 8 and 9, once ice making is requested, the ice maker 100 is turned on, and an ice making operation starts (S1). Once the ice making operation starts, the water supply unit 110 supplies water to the ice making cylinders 121 of the tray 120 (S2). Here, a water supply amount is real-time sensed by a water level sensor installed at the tray 120, or a flow amount sensor installed at a water supply pipe, or a water level sensor installed at a water tank. Then, the sensed water supply amount is transmitted to the microcomputer. The microcomputer compares the received water supply amount with a preset water supply amount (S3). Based on the comparison, it is determined whether a preset amount of water has been supplied to the ice making cylinders 121 of the tray 120. If it is determined that a preset amount of water has been supplied to the ice making cylinders 121 of the tray 120, a water supply valve of the water supply unit 110 is blocked to stop a supply water to the ice making cylinders 121 of the tray 120.

Once the water supply to the ice making cylinders 121 of the tray 120 has been completed, the water inside the tray 120 is exposed to cool air supplied to the ice making chamber 51 for a predetermined time, to be frozen (S5). While the water inside the tray 120 is being frozen, a temperature sensor periodically or real-time senses the temperature of the tray 120 to transmit the sensed temperature to the microcomputer 150. Then, the microcomputer 150 compares the sensed temperature with a preset temperature (S6). Based on this comparison, it is determined whether the water inside the tray 120 has been frozen. If it is determined that the water inside the tray 120 has been frozen, all the processes are stopped (S7) to await an ice separating operation.

Once ice separation is requested (S8), the driving motor 131 is operated by the control unit 150. Accordingly, the tray 120 is rotated centering around the hinge protrusions 124. While the tray 120 is rotated, the connecting unit 137 slides along the piston guides 133. As a result, the pistons 132 are gradually pressed toward the openings of the ice making cylinders 121 (S10). Then, the head portions 135 of the pistons 132 push up the ice. And, the upwardly pushed ice is separated from the ice making cylinders 121 to be discharged to a chute tube or an ice storage container provided below the tray 120 (S11~S12). In case of implementing the heater (S9), the heater and the driving motor 131 are operated by the control unit 150. Once the heater is operated, heat is supplied to the tray 120, thereby melting an outer surface of the ice contacting an inner surface of the tray 120. Accordingly, the ice is easily separated from the tray 120.

While the ice is being separated from the tray 120 or while the ice separating operation is prepared, supply of cool air to the ice making chamber 51 is preferably stopped in order to facilitate the ice separating operation, and in order to reduce power supplied to the heater in the case of implementing the heater.

Once the ice discharging operation is completed, the driving motor 131 is rotated in a reverse direction, thereby rotating the tray 120 back into the original position with the openings of the ice making cylinders 121 directed upwardly, and the pistons 132 lowered to the opposite sides to the openings of the ice making cylinders 121 to thereby form the ice making spaces (S). While the water supply valve 112 is opened, a proper amount of water is supplied to the ice making cylinders 121 of the tray 120 by the water level sensor and the flow amount sensor. These processes are repeatedly performed. In the case of implementing the heater, the operation of the heater is also stopped.

Under these configurations, as the ice making unit and the ice separation unit are integrally formed with each other, the entire size of the ice maker may be reduced, and thus the refrigerator having the ice maker may be implemented to have a slim configuration. More specifically, in the conventional art, a tray has a wide width, and an ice separation unit for separating ice from the ice maker has a wide width. Accordingly, the conventional refrigerator having the ice maker has a limitation in having a slim configuration. However, in the present invention, since the ice maker is provided with the tray having a small diameter, an occupation area occupied by the ice maker in the refrigerator is small.

Furthermore, since an installation height of the ice maker is lowered, a path for supplying cool air may be shortened. This may prevent loss of cool air being supplied to the ice making chamber. More specifically, in the conventional art, an ice separation unit is provided for separating the ice made in the ice maker. However, in the present invention, the tray serves to separate the ice by being rotated, thereby eliminating the need for an additional ice separation unit. Accordingly, the ice maker has a lowered installation height, thereby reducing the distance between the freezing chamber and the ice making chamber. This may shorten the path for supplying cool air, thereby reducing loss of cool air, and reducing loss of an input for driving the ice maker.

Furthermore, since the ice maker has a simplified configuration and precise operation controls, the fabrication costs may be reduced, and inferiority of the ice maker due to malfunctions may be prevented. More specifically, in the conventional art, ice is separated from the ice maker by a torsion method, a heating method, a rotation method, etc. However, in the present invention, ice is mechanically separated from the ice maker by rotating the tray by a rotation force of the driving motor, and by automatically moving the pistons up and down when the tray is rotated. This may allow the ice maker to have a simplified configuration and precise operation controls. As a result, the fabrication costs for the ice maker may be reduced, and inferiority of the ice maker due to malfunctions may be prevented to enhance reliability of the ice maker.

Hereinafter, an ice maker according to another embodiment of the present invention will be explained.

Figure 10:
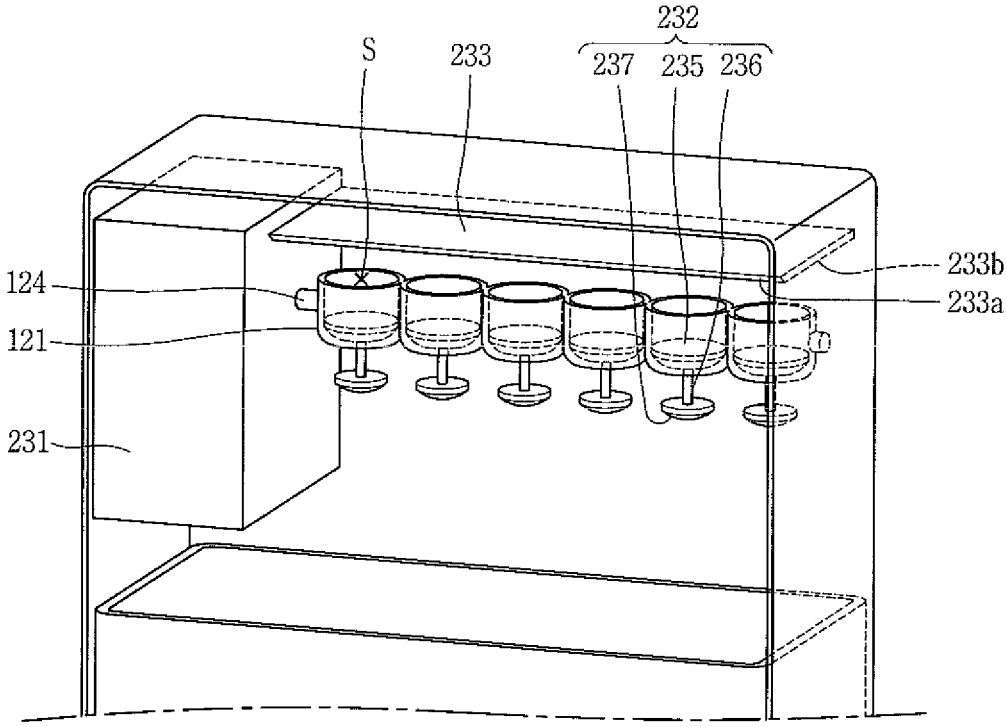
FIG. 10 is a perspective view showing the ice maker of FIG. 1 according to another embodiment of the present invention.
Figure 11A:
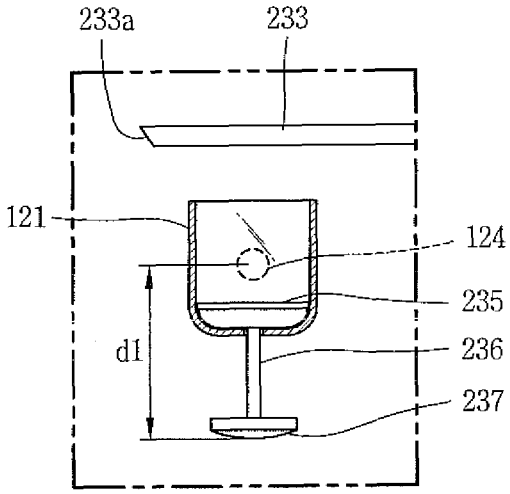
FIGS. 11(*a*)-11(*b*) are schematic views showing an ice separating process by a piston of the ice maker of FIG. 10.
Figure 11B:
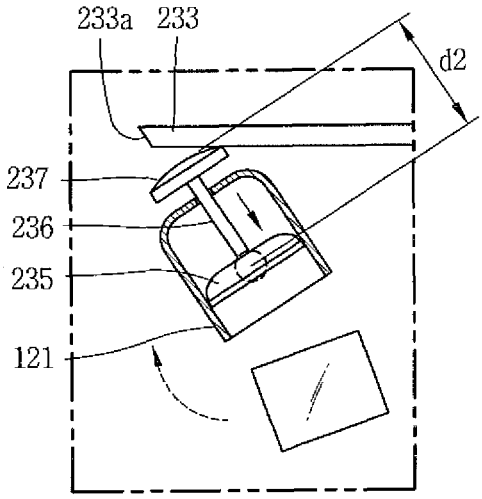
Figure 12:
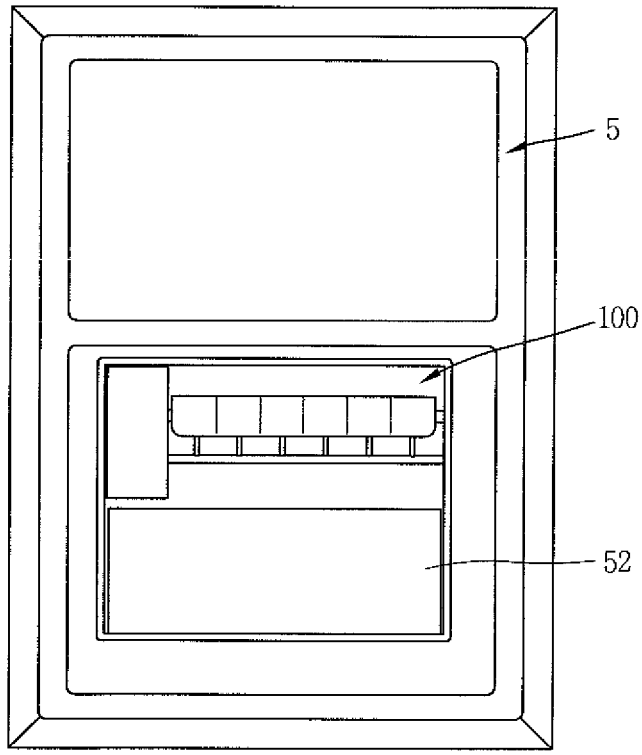
FIG. 12 is a rear view showing an arrangement structure of the ice maker of FIG. 2 and a dispenser according to another embodiment of the present invention.

In the aforementioned embodiment, the pistons 132 are connected to each other by the connecting unit 137. However, in another embodiment shown in FIGS. 10 and 11, pistons 232 are not connected to each other, but are installed so as to be independent from each other.

The pistons 232 include head portions 235 slidably inserted into the ice making cylinders 121, and rod portions 236 independently provided on bottom surfaces of the head portions 235 for pushing the head portions 235 by being pressed by a piston guide 233. Stoppers 237 are independently provided at the ends of the rod portions 236 so as to be locked by the sliding holes 122 of the ice making cylinders 121. Alternatively, the stoppers 237 may be connected to each other.

In contrast with the aforementioned embodiment, the piston guide 233 is installed above the ice making cylinders 121 so as to have a long length in a horizontal direction.

The piston guide 233 may be formed to have a long plate shape in a horizontal direction. An introduction end 233*a* may be formed to be round or inclined so that the rod portions 236 of the pistons 232 can be smoothly introduced thereinto. Also, the piston guide 233 between its two ends in a rotation direction of the pistons 232 may be formed to be round or inclined.

The ice maker according to the second embodiment has similar configurations and effects as those of the ice maker according to the first embodiment, and thus detailed explanations thereof will be omitted. The ice maker according to the second embodiment is different from the ice maker according to the first embodiment in that the pistons 232 are independently installed from each other. In this case, the aforementioned connecting unit for connecting the pistons 232 to each other is not required. This may prevent a load from being concentrated on the connecting unit, thereby preventing the pistons 232 from being damaged or malfunctioning.

The refrigerator having the ice maker according to the present invention has the following operation and effects.

In case of a 3-door bottom freezer type refrigerator having the ice making chamber at the refrigerating chamber and operating the ice maker by guiding cool air to the ice making chamber from the freezing chamber, a space occupied by the ice maker may be reduced, thereby providing a slim configuration of the refrigerator. In case of a built-in refrigerator having a reduced depth in a front-to-rear direction for combination with other structures, a refrigerating chamber door may have a reduced thickness by applying the ice maker thereto. This may enhance a degree of freedom to install the refrigerator.

In case of applying the ice maker to the refrigerator, the ice inside the tray 120 is automatically separated from the tray 120 when the tray 120 is rotated. This may lower an installation height of the ice maker, and thus the ice maker 100 may be arranged at a lower part of the refrigerating chamber door 5. This may reduce a length of a flow path between the freezing chamber 2 and the ice making chamber 51. Accordingly, loss of cool air that may occur while supplying cool air to the ice making chamber 51 from the freezing chamber 2 may be greatly reduced, thereby lowering power consumption of the refrigerator. This may also increase an effective volume of the refrigerating chamber door.

The ice maker, the refrigerator having the same, and the ice making method thereof maybe applicable to all types of refrigerating appliances having ice makers, such as two-door refrigerators, side-by-side refrigerators, and stand-alone freezers without refrigerating chambers.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds, are therefore intended to be embraced by the appended claims.

What is claimed is:

1. An ice maker, comprising:

a tray having an ice making space;

a driving unit configured to rotate the tray; and an ice moving member linearly movable within the ice making space upon rotation of the tray to eject ice from the tray, wherein the tray comprises an ice making cylinder having an ice making space, wherein the ice moving member includes a piston slidably movable within the ice making cylinder in a longitudinal direction of the ice making cylinder, and wherein the piston comprises:

a head portion slidably coupled to an inner circumferential surface of the ice making cylinder; and a rod portion coupled to the head portion and extending in a moving direction of the piston, wherein the ice moving member further comprises a connecting unit coupled to the rod portion; and a piston guide operably connected to the connecting unit for guiding movement of the connecting unit.

2. The ice maker of claim 1, wherein the tray is configured to rotate from a first position where an opening of the tray is directed upwardly, to a second position where the opening of the tray is directed downwardly.

3. The ice maker of claim 1, wherein the tray comprises a plurality of ice making cylinders each having an ice making space and connected to each other, and wherein the ice moving member is coupled to each of the ice making cylinders.

4. The ice maker of claim 3, wherein the plurality of ice making cylinders are provided with a water flow path such that the ice making spaces are communicated to each other.

5. The ice maker of claim 4, wherein a water supply unit for supplying water to the ice making cylinders is installed above at least one of the ice making cylinders.

6. The ice maker of claim 1, wherein the tray includes a hinge member located at one end of the tray, the hinge member including a passageway therein, and wherein a water supply unit is connected to the passageway of the hinge member so as to supply water to the ice making tray through the hinge member.

7. The ice maker of claim 1, wherein the piston guide is formed in an arc shape eccentric from a rotation center of the tray.

8. The ice maker of claim 1, wherein the ice making cylinder includes a sliding hole for slidably coupling the rod portion, and wherein a stopper is formed at the end of the rod portion so as to be locked by the sliding hole.

9. The ice maker of claim 1, wherein the tray comprises a plurality of ice making cylinders each having an ice making space, and wherein the ice moving member includes a plurality of pistons slidably movable within the ice making cylinders in a longitudinal direction of the ice making cylinders.

10. The ice maker of claim 9, wherein the pistons comprise:

head portions slidably coupled to an inner circumferential surface of the ice making cylinders; and rod portions coupled to the head portions and extending in a moving direction of the pistons, wherein the ice moving member further comprises a connecting unit coupled to the rod portions; and a piston guide operably connected to the connecting unit for guiding movement of the connecting unit.

11. An appliance, comprising:

a body including an ice making chamber;

an ice maker located in the ice making chamber, the ice maker including:

a tray having an ice making space;

a driving unit configured to rotate the tray; and an ice moving member linearly movable within the ice making space upon rotation of the tray to eject ice from the tray, wherein the body is a refrigerator body having a refrigerating chamber and a freezing chamber, and wherein the ice making chamber is located in the refrigerating chamber.

12. The appliance of claim 11, further comprising a door configured to open and close the refrigerating chamber, wherein the ice making chamber is located at the door.

13. The appliance of claim 12, further comprising a dispenser located at the refrigerator door for drawing out ice made in the ice making chamber, wherein at least a portion of the ice making chamber is located at a same height as a portion of the dispenser.

14. An ice making method, comprising:

supplying water to a tray;

cooling the water contained in the tray to produce an ice mass;

rotating the tray; and linearly moving an ice moving member within the tray to eject the ice mass from the tray, wherein the supplying water to the tray comprises sensing time or an amount of the water supplied to the tray, and determining whether the sensed time or water amount has reached a preset value.

15. The method of claim 14, wherein at least a portion of the rotating of the tray is performed prior to a beginning of the linearly moving of the ice moving member.

16. The method of claim 14, wherein the linearly moving of the ice moving member is performed simultaneously with the rotating of the tray.

* * * * *